US006633265B2

(12) United States Patent
Hirabe

(10) Patent No.: US 6,633,265 B2
(45) Date of Patent: Oct. 14, 2003

(54) NULL DIRECTION CONTROL METHOD FOR ARRAY ANTENNA

(75) Inventor: Masashi Hirabe, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/117,044

(22) Filed: Apr. 8, 2002

(65) Prior Publication Data

US 2002/0191246 A1 Dec. 19, 2002

(30) Foreign Application Priority Data

Apr. 9, 2001 (JP) ..... 2001-110539

(51) Int. Cl.[7] ..... H01Q 3/26
(52) U.S. Cl. ..... 343/853; 342/372
(58) Field of Search ..... 343/853; 342/372, 342/377, 363, 383, 379, 17; 455/278.1, 296, 562, 517

(56) References Cited

U.S. PATENT DOCUMENTS 4,720,712 A 1/1988 Brookner et al. ..... 342/383
5,818,517 A * 10/1998 Hudson et al. ..... 348/21
5,926,135 A * 7/1999 Minkoff ..... 342/379
6,075,484 A * 6/2000 Daniel et al. ..... 342/372
6,154,661 A * 11/2000 Goldberg ..... 455/562
6,486,828 B1 * 11/2002 Cahn et al. ..... 342/363

FOREIGN PATENT DOCUMENTS

JP 2000-138520 A 5/2000

OTHER PUBLICATIONS

M. Ohmiya et al., "Howells–Appelbaum Adaptive Super-resolution Array for Accelerated Scanning", *IEEE Transactions on Antennas and Propagation*, vol. 36, No. 12, XP 000007859, Dec. 1998, pp. 1700–1706.

* cited by examiner

*Primary Examiner*—James Clinger
(74) *Attorney, Agent, or Firm*—Sughrue Mion, PLLC

(57) ABSTRACT

A null direction control method allows optimum antenna weights forming designated null beam directions without calculating an inverse matrix. In an N-element array antenna, a designated null beam antenna pattern is obtained by processing a 2-element antenna weight vector forming a null in a sequentially selected one of M designated null directions and a (N–M)-element antenna weight vector forming a beam in a designated beam direction to produce an antenna weight vector for the N-element array antenna. The final antenna weight vector is calculated by incrementing the number of elements of a work antenna weight vector each time a null is formed in a sequentially selected one of the M designated null directions.

12 Claims, 7 Drawing Sheets

3-ELEMENT ARRAY ANTENNA

5-ELEMENT ARRAY ANTENNA

4-ELEMENT ARRAY ANTENNA

6-ELEMENT ARRAY ANTENNA

NULL DIRECTION CONTROL METHOD FOR ARRAY ANTENNA

BACKGROUND OF THE INVENTION

1. Field of the Invention

The present invention relates to an array antenna system and in particular to a technique of calculating antenna weights for null direction control.

2. Description of the Prior Art

In base stations of a mobile communications system, signals received by respective antenna elements of an array antenna are subjected to adaptive signal processing to form nulls in incoming directions of interference waves, which allows the interference to be suppressed. In addition, the null pattern obtained from the received signals is also used for signal transmission.

In the case of asymmetric communication such as Web access using ADSL (asymmetric digital subscriber line) service, however, the null pattern obtained from the received signals is not always best suited for transmission. In this case, it is necessary to determine null directions in some way and form nulls in the determined directions.

Antenna weights forming nulls in desired directions can be obtained by using a Howells-Applebaum adaptive array control algorithm in a model which is formed when the antenna weights are calculated and receives a signal wave and interference waves at designated directions. Details of the Howells-Applebaum adaptive array control algorithm are discussed in, for example, Chapter 4 titled MSN adaptive array, pp. 67–86, "Adaptive Signal Processing by Array Antenna" by Nobuo Kikuma, SciTech Press.

FIG 1 is a flow chart showing a conventional null direction control method using the Howells-Applebaum adaptive array control algorithm. When null and beam forming directions, θ beam, θ null(l), . . . , θ null(M), are designated, steering vectors, Abeam, Anull_1, . . . , Anull_M, in the null and bean forming directions are generated and then are combined to produce Asum. The combined steering vectors Asum is used to calbulate a covariance matrix $R_{AA}$. An inverse matrix of $R_{AA}$ is used to calculate the optimum weights, Wbeam, of the array antenna.

However, the optimum weight computation according to the above prior art needs the inverse matrix calculation. This causes processing time and amount of calculation to be increased, resulting in lowered processing speed and increased amount of hardware.

SUMMARY OF THE INVENTION

An object of the present invention is to provide a null direction control method which can obtain optimum antenna weights forming designated null beam directions without calculating an inverse matrix.

In an N-element array antenna, a designated null beam antenna pattern is obtained by processing a 2-element antenna weight vector forming a null in a sequentially selected one of M designated null directions and a (N–M)-element antenna weight vector forming a beam in a designated beam direction to produce an antenna weight vector for the N-element array antenna. The final antenna weight vector is calculated by incrementing the number of elements of a work antenna weight vector each time a null is formed in a sequentially selected one of the M designated null directions.

According to an aspect of the present invention, a method for producing an antenna weight vector for an N-element array antenna to form a designated antenna pattern having a single beam direction θ beam and M null directions θ null(1)–θ null (M) (1=<M=<N–2), includes the steps of: a) producing a work antenna weight vector for a (N–M)-element array antenna to form a beam in the single beam direction; b) sequentially selecting one of the M null directions; c) producing a 2-element antenna weight vector for a 2-element array antenna to form a null in the selected null direction; d) multiplying the work antenna weight vector by a first weight and a second weight of the 2-element antenna weight vector to produce a first work weight vector and a second work antenna weight vector; e) appending 0 to a trail end of the first work weight vector and to a head of the second work weight vector to produce a first expanded weight vector and a second expanded weight vector, and adding the first expanded weight vector and the second expanded weight vector to produce a work antenna weight vector; and f) repeating the steps (c)–(e) until antenna weight vector as the antenna weight vector for an N-element array antenna.

The step (a) may include the step of calculating the work antenna weight vector $W_{pattern}=[W_{beam(1)}, \ldots, W_{beam(N-M)}]$ using the following expressions:

$$\delta w_{beam}=exp\{-j\cdot k\cdot d\cdot \sin(\theta\ \text{beam})\},$$

$$w_{beam(l)}=1,$$

and $$w_{beam(i)}=w_{beam(i-1)}\cdot\delta w_{beam}\ (i=2, 3, \ldots, N-M),$$

where d is a distance between antenna elements of the N-element array antenna, k is propagation constant of free space ($k=2\pi/\lambda$), λ is wavelength in free space.

The step (c) may include the step of calculating the 2-element antenna weight vector $W_{null(m)}=[w_{null_1(m)}, w_{null_2(m)}]$ using the following expressions:

$$\delta w_{null(m)}=-\exp\{-j\cdot k\cdot d\cdot \sin(\theta\ \text{null}(m))\},$$

$$w_{null_1(m)}=1,$$

and $$w_{\text{null_2}(m)} = w_{\text{null_1}(m)}\cdot\delta w_{null(m)}$$
$$= -\exp\{-j\cdot k\cdot d\cdot \sin(\theta null(m))\},$$

where m=1, 2, . . . , M.

The step (d) may include the step of calculating the first work weight vector $W_{beam1}$ and the second work antenna weight vector $W_{beam2}$ using the following expressions:

$$W_{beam1}=w_{null_1(m)}\cdot W_{pattern}=1\cdot W_{pattern},$$

and $$w_{beam2} = w_{\text{null_2}(m)}\cdot w_{pattern}$$
$$= \exp\{-j\cdot k\cdot d\cdot \cos(\theta null(m))\}\cdot w_{pattern}.$$

The step (e) may include the steps of: appending 0 to the trail end of the first work weight vector $W_{beam1}$ and to the head of the second work weight vector $W_{beam2}$ to produce the first expanded weight vector $[W_{beam1}, 0]$ and the second expanded weight vector $[0, W_{beam2}]$; and adding the first expanded weight vector and the second expanded weight vector to produce the work antenna weight vector $$W_{pattern}=[W_{beam1}, 0]+[0, W_{beam2}].$$

According to anther aspect of the present invention, a method for producing an antenna weight vector for an N-element array antenna to form a designated antenna pattern having M null directions θ null(1)–θ null(M) (1=<M=<N−1), includes the steps of: a) arbitrarily preparing a work antenna weight vector for a (N−M)-element array antenna; b) sequentially selecting one of the M null directions; c) producing a 2-element antenna weight vector for a 2-element array antenna to form a null in the selected null direction; d) multiplying the work antenna weight vector by a first weight and a second weight of the 2-element antenna weight vector to produce a first work weight vector and a second work antenna weight vector; e) appending 0 to a trail end of the first work weight vector and to a head of the second work weight vector to produce a first expanded weight vector and a second expanded weight vector, and adding the first expanded weight vector and the second expanded weight vector to produce a work antenna weight vector; and f) repeating the steps (c)–(e) until the M null directions have been selected, to produce a fluid work antenna weight vector as the antenna weight vector for an N-element array antenna.

DESCRIPTION OF THE PREFERRED EMBODIMENTS

Figure 1:
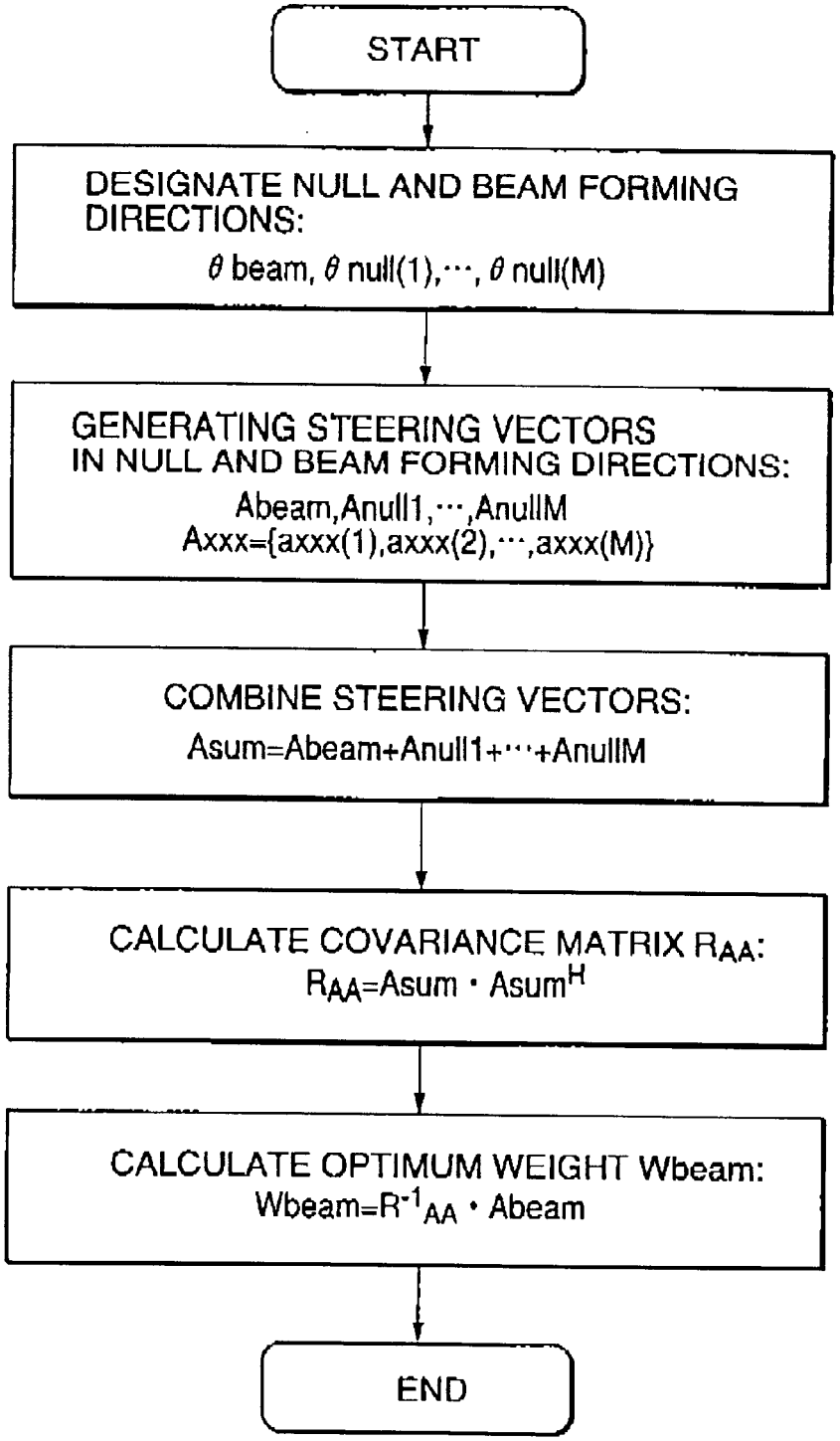
FIG.1 (PRIOR ART)
FIG. 1 is a flow chart showing a conventional null direction control method using the Howells-Applebaum adaptive array control algorithm.

Hereinafter, embodiments of the present invention will be described in detail by referring to the drawings.

Figure 2:
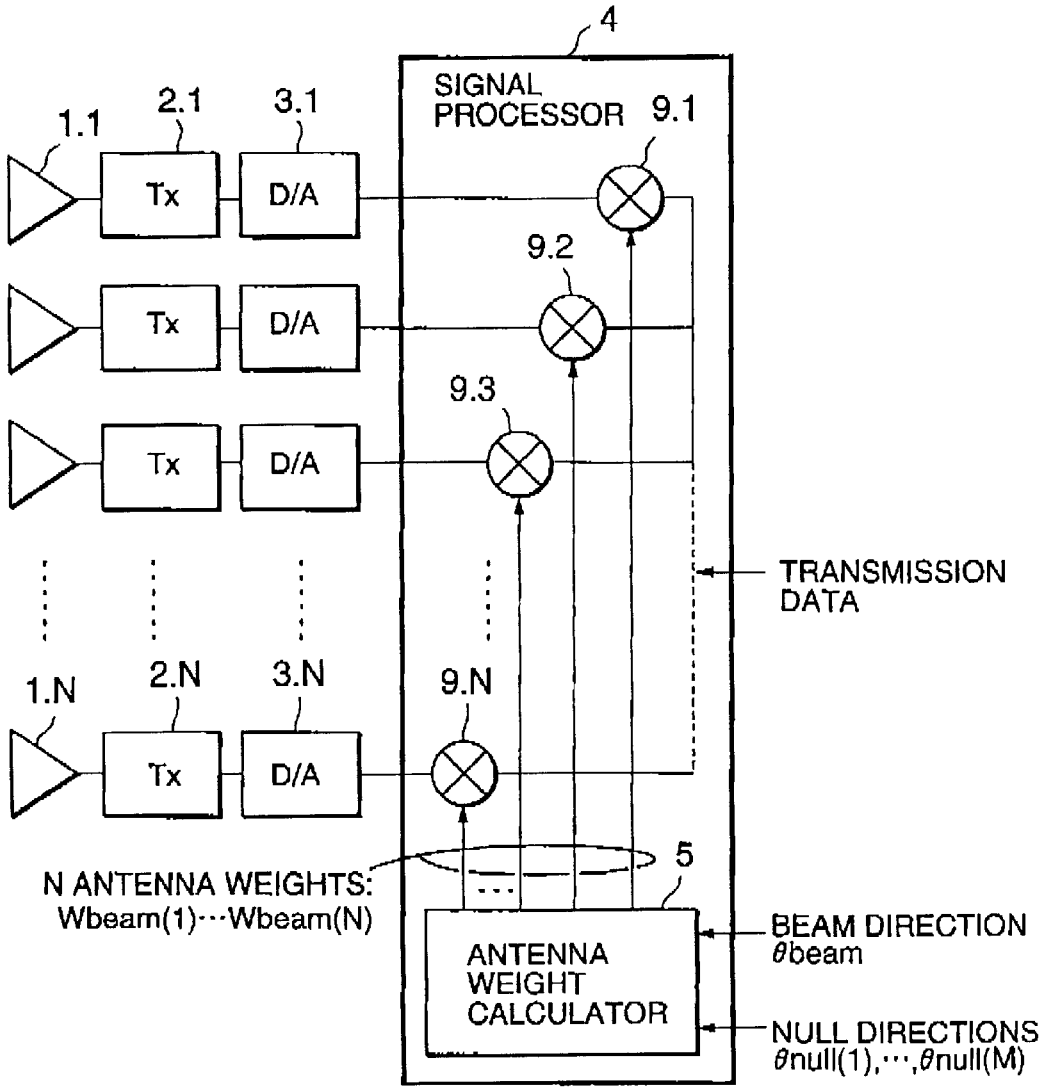
FIG. 2 is a block diagram showing a transmission digital beam forming apparatus employing a null direction control method according to the present invention.

Referring to FIG. 2, an array antenna is composed of N antenna elements 1.1–1.N, which are spaced uniformly and aligned in a line. The respective antenna elements 1.1–1.N are connected to N transmitters 2.1–2.N, which are in turn connected to a signal processor 4 through N digital-to-analog (D/A) converters 3.1–3.N.

The signal processor 4 includes N multipliers 9.1–9.N and an antenna weight calculator 5. The multipliers 9.1–9.N are connected to the D/A converters 3.1–3.N and assign antenna weights $w_{beam(1)}$–$w_{beam(N)}$ to transmission data, respectively. The antenna weights $w_{beam(1)}$–$w_{beam(N)}$ are calculated from designated beam direction θ beam and null directions θ null(1), . . . , null(M) by the antenna weight calculator 5.

The signal processor 4 including the multipliers 9.1–9.N and the antenna weight calculator 5 is implemented by a digital signal processor on which an antenna weight calculation program is running, which will be described later.

In the above circuit, when the transmission data enters the signal processor 4, the multipliers 9.1–9.N multiply the transmission data by respective ones of the antenna weights $w_{beam(1)}$–$w_{beam(N)}$ generated by the antenna weight calculator 5. In this way, N weighted streams of transmission data are converted from digital to analog by the D/A converters 3.1–3.N, respectively. The respective analog transmission signals are transmitted by the transmitters 2.1–2.N through the antenna elements 1.1–1.N.

Antenna Weight Calculation (1)

Figure 3:
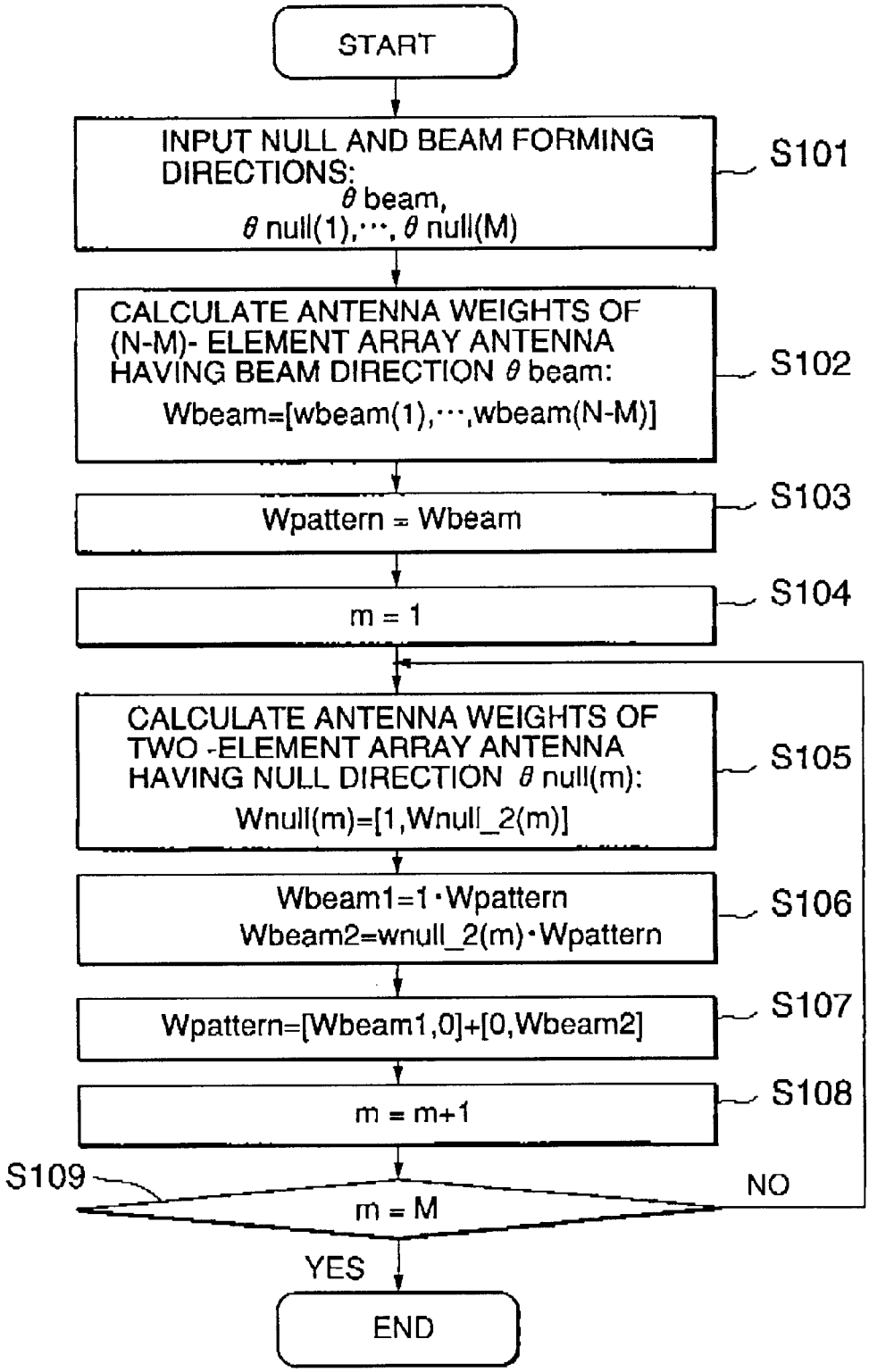
FIG. 3 is a flow chart showing a null direction control method according to a first embodiment of the present invention.

Referring to FIG. 3, a beam forming direction θ beam and null forming directions θ null(1), . . . , θ null (M) are inputted to the antenna weight calculator 5 (step S101). Here, M is the number of nulls whose directions are designated and M is restricted to N−2 or less.

When inputting these directions, the antenna weight calculator 5 calculates an antenna weight vector $W_{beam}$ to be assigned to a (N−M)-element array antenna having the beam forming direction θ beam using the following expressions (1)–(4):

$$W_{beam}=[w_{beam(1)}, \ldots, w_{beam(N-M)}] \quad (1),$$

$$\delta w_{beam}=exp\{-j\cdot k\cdot d\cdot \sin(\theta\ \text{beam})\} \quad (2),$$

$$w_{beam(1)}=1 \quad (3),$$

and $$w_{beam(i)}=w_{beam(i-1)}\cdot\delta w_{beam}:\ i=2, 3, \ldots, N-M \quad (4),$$

where d is a distance between antenna elements, k is propagation constant of free space (k=2π/λ), λ is wavelength in free space (step S102). Thereafter, $$W_{pattern}=W_{beam} \quad (5)$$

and m=1 (steps S103, S104) and the following steps S105–S109 are repeatedly performed until m=M, where m=1, 2, . . . , M.

Step S105

An antenna weight $W_{null(m)}$ for a 2-element array antenna forming null in the direction θ null(m) is calculated by the following expressions (6)–(9):

$$W_{null(m)}=[w_{null_1(m)}, w_{null_2(m)}] \quad (6),$$

$$\delta w_{null(m)}=-exp\{-j\cdot k\cdot d\cdot \sin(\theta\ \text{null}(m))\} \quad (7),$$

$$w_{null_1(m)}=1 \quad (8),$$

and $$w_{\text{null_2}(m)} = w_{\text{null_1}(m)} \cdot \delta w_{null(m)} \tag{9}$$

$$= -\exp\{-j \cdot k \cdot d \cdot \sin(\theta null(m))\}.$$

Step S106

Using $W_{pattern}$ and $W_{null(m)}$, two antenna weight vectors $W_{beam1}$ and $W_{beam2}$ for a (N−M)-element array antenna are calculated by the following expressions (10) and (11):

$$W_{beam1}=w_{null_1(m)} \cdot W_{pattern}=1 \cdot W_{pattern} \tag{10};$$

and $$w_{beam2} = w_{\text{null_2}(m)} \cdot w_{pattern} \tag{11}$$

$$= \exp\{-j \cdot k \cdot d \cdot \cos(\theta null(m))\} \cdot w_{pattern}.$$

Step S107

Appending 0 to the trail end of $W_{beam1}$ and to the head of $W_{beam2}$, antenna weight vectors for the (N−M+1)-element array antenna are calculated and added to produce $W_{pattern}$ using the following expression:

$$W_{pattern}=[W_{beam1}, 0]+[0, W_{beam2}] \tag{12}.$$

Thereafter, m is incremented (step S108) and it is determined whether m=M (step S109). If m does not reach M (NO in step S109), control goes back to the step S105 and the steps S105–S108 are repeated until m=M.

In this manner, a final antenna weight vector $W_{pattern}=[w_{beam(1)}, \ldots, w_{beam(n)}]$ is obtained and these antenna weights are output to respective ones of the multipliers 9.1–9.N. In other words, each of the beam and null directions is designated by a single complex weight and these complex weights are only multiplied and added to produce a final antenna pattern having the designated beam direction θ beam and null directions θ null(1), . . . , θ null (M), resulting in decreased amount of computation.

EXAMPLE

As an example, the case of N=6 and M=3 will be described below. In this example, a single beam directionθ beam and three null directions θ null(1), θ null(2) and θ null(3) are designated in a 6-element array antenna system.

Figure 4:
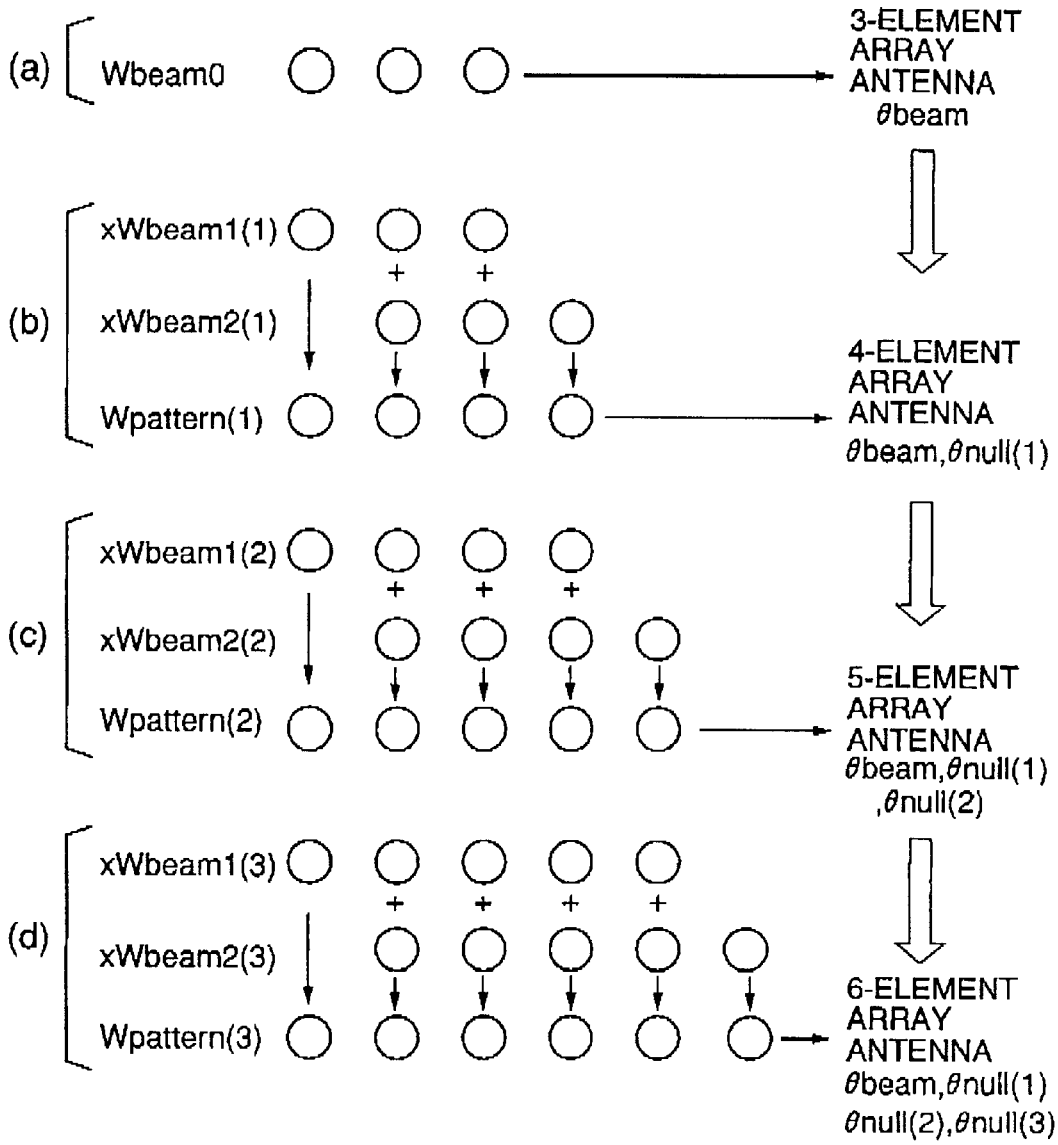
FIG. 4 is a schematic diagram showing a flow of generating a single beam and three nulls in the case where the null direction control method according to the first embodiment is applied to a 6-element array antenna.
Figure 5A:
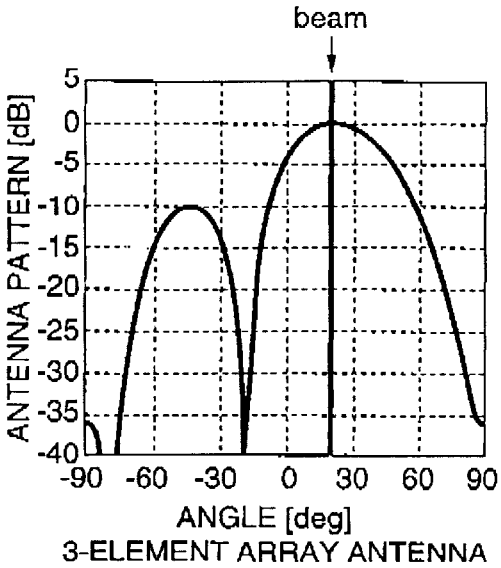
FIG. 5A is a graph showing an antenna pattern in the stage of 3-element array antenna as shown in FIG. 4(*a*)
Figure 5C:
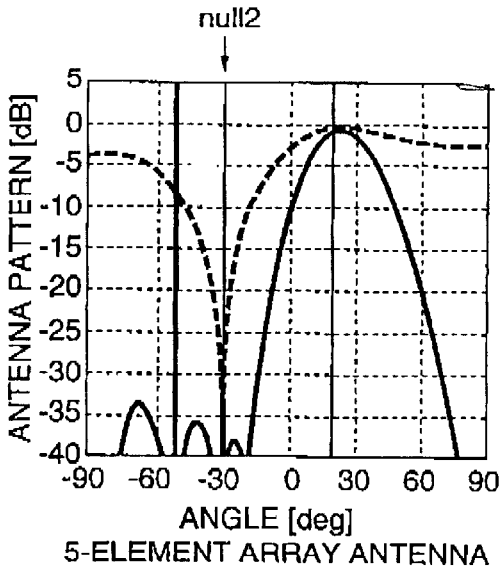
FIG. 5C is a graph showing an antenna pattern in the stage of 5-element array antenna as shown in FIG. 4(*c*)
Figure 5B:
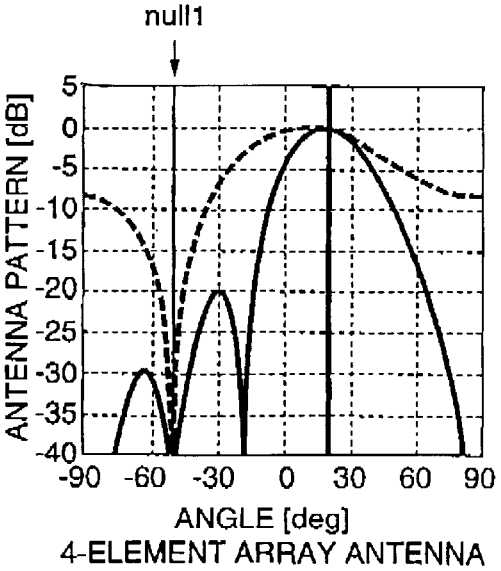
FIG. 5B is a graph showing an antenna pattern in the stage of 4-element array antenna as shown in FIG. 4(*b*)
Figure 5D:
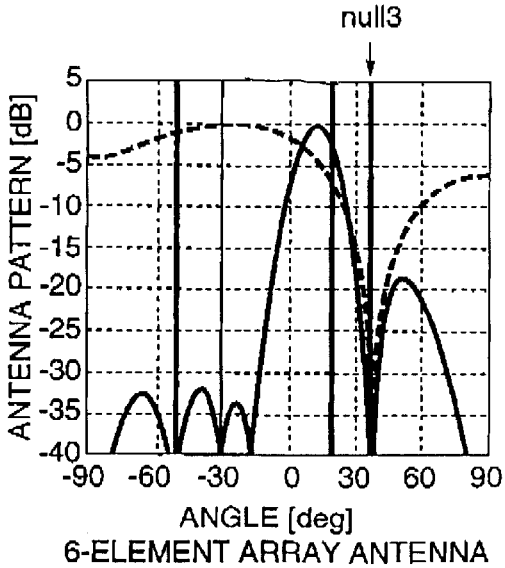
FIG. 5D is a graph showing an antenna pattern in the stage of 6-element array antenna as shown in FIG. 4(*d*)

Since N−M=3, as shown in FIG. 4(*a*), an antenna weight vector $W_{beam0}$ of a 3-element array antenna having the beam direction θ beam is first calculated by the expressions (1)–(4).

Subsequently, the expressions (6)–(9) are first used to calculate an antenna weight vector $W_{null(1)}$ of a 2-element array antenna forming null in the direction θ null(1). Using this $W_{null(1)}$ and the above $W_{beam0}$, two antenna weight vectors $W_{beam3(1)}$ and $W_{beam2(1)}$ for the 3-element array antenna are calculated according to the expressions (10) and (11). By appending 0 to the trail end of $W_{beam(1)}$ and to the head of $W_{beam2(1)}$, two antenna weight vectors for a 4-element array antenna are calculated and added to produce $W_{pattern(1)}$ using the expression (12) as shown in FIG. 4(*b*).

Similarly, the expressions (6)–(9) are used to calculate an antenna weight vector $W_{null(2)}$ of a 2-element array antenna forming null in the direction θ null(2). Using this $W_{null(2)}$ and the above $W_{pattern(1)}$, two antenna weight vectors $W_{beam1(2)}$ and $W_{beam2(2)}$ for the 4-element array antenna are calculated according to the expressions (10) and (11). By appending 0 to the trail end of $W_{beam1(2)}$ and to the head of $W_{beam2(2)}$, two antenna weight vectors for a 5-element array antenna are calculated and added to produce $W_{pattern(2)}$ using the expression (12) as shown in FIG. 4(*c*).

Since m does not reach M=3, the expressions (6)–(9) are similarly used to calculate an antenna weight vector $W_{null(3)}$ of a 2-element array antenna forming null in the direction θ null (3). Using this $W_{null(3)}$ and the above $W_{pattern(2)}$, two antenna weight vectors $W_{beam(3)}$ and $W_{beam(3)}$ for the 5-element array antenna are calculated according to the expressions (10) and (11) By appending 0 to the trail end of $W_{beam(3)}$ and to the head of $W_{beam2(3)}$, two antenna weight vectors for a 6-element array antenna are calculated and added to produce $W_{pattern(3)}$ using the expression (12) as shown in FIG. 4(*d*).

In this manner, the final antenna weight vector $W_{pattern(3)}=[w_{beam(1)}, \ldots, w_{beam(6)}]$ is obtained and these antenna weights $w_{beam(1)}, \ldots, w_{beam(6)}$ are output to respective ones of the multipliers 9.1–9.6 and thereby amplitude and phase of transmission data are controlled Accordingly, a single beam having the designated beam direction θ beam and three nulls having the directions θ null(1), θ null(2) and θ null(3) can be obtained without inverse-matrix calculation. In this example, three complex weights $W_{null(1)}$, $W_{null(2)}$, $W_{null(3)}$ are used to designate the respective null directions.

FIGS. 5A–5D show antenna patterns corresponding to the respective stages of 3-element, 4-element, 5-element, and 6-element array antennas as shown in FIG. 4(*a*), 4(*b*), 4(*c*), and 4(*d*). In FIGS. 5A–5D, dashed lines denote an antenna pattern corresponding to the expression (6) and solid lines denote an antenna pattern corresponding to the expressions (5) and (12).

In this manner, a final complex antenna weight $W_{pattern}=[w_{bean(1)}, \ldots, w_{beam(6)}]$ is obtained and these antenna weights are output to respective ones of the multipliers 9.1–9.6. In other words, each of the beam and null directions is designated by a single complex weight and these complex weights are only multiplied and added to produce a final antenna pattern having the designated beam direction 6 beam and null directions θ null(1), θ null(2) and θ null(3). Accordingly, there is no need of inverse-matrix computation, resulting in decreased amount of calculation.

Antenna Weight Calculation (2)

A second embodiment of the present invention will he described with reference to FIG. 6. In the second embodiment, only null directions θ null(1), . . . , θ null(M) are designated to produce antenna weights forming a designated null direction.

Figure 6:
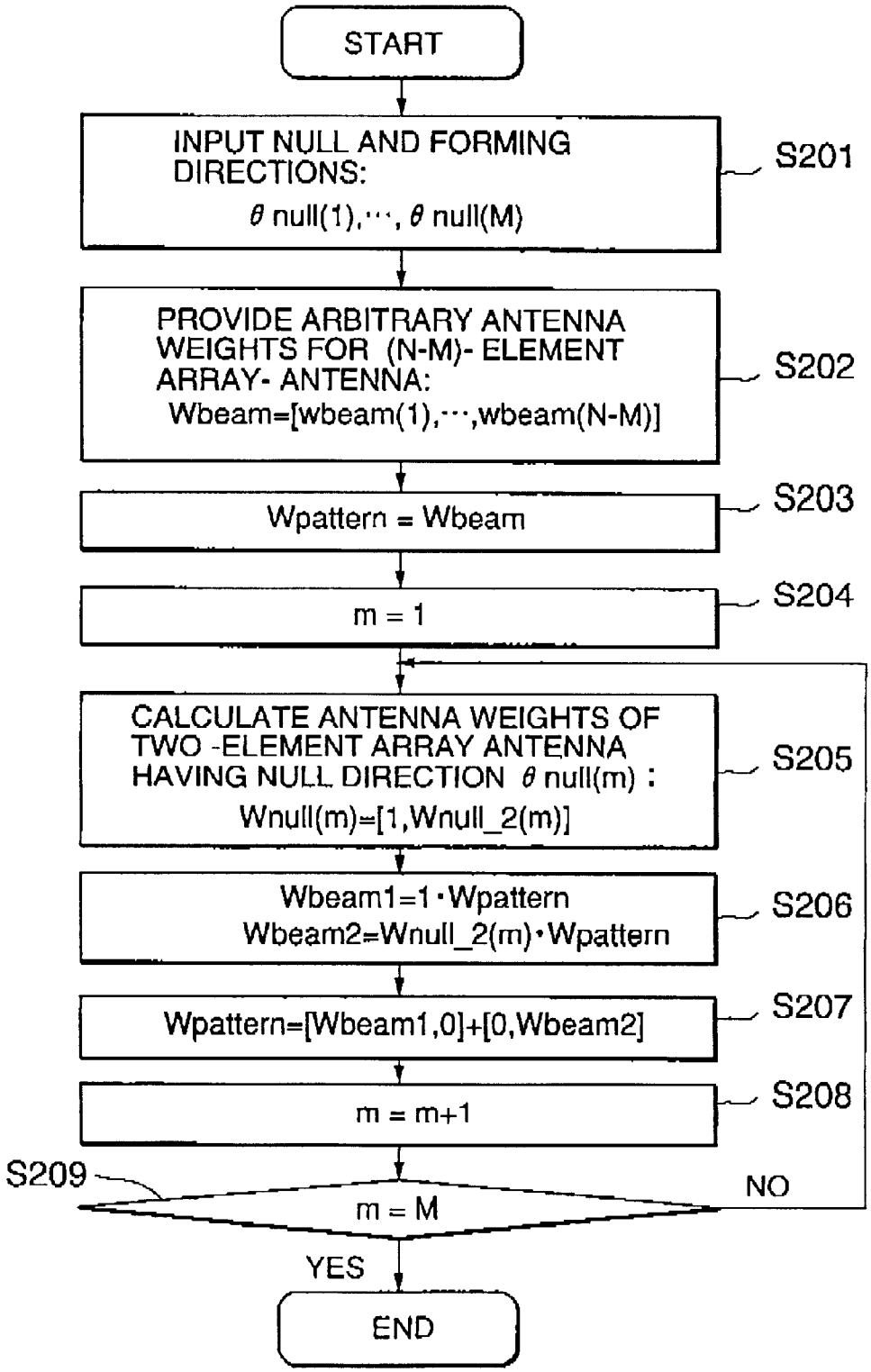
FIG. 6 is a flow chart showing a null direction control method according to a second embodiment of the present invention.

Referring to FIG. 6, the null forming directions θ null(1), . . . , θ null(M) are inputted to the antenna weight calculator 5 (step S201). Here, M is the number of nulls whose directions are designated and M is restricted to N−1 or less.

Thereafter, an arbitrary antenna weight vector $w_{beam}$ to be assigned to a (N−M)-element array antenna as represented by the following expression (13):

$$W_{beam}=[w_{beam(1)}, \ldots, w_{beam(N-M)}] \tag{13}$$

(step S202). Thereafter, $W_{pattern}=W_{beam}$ and m=1 (steps S203, S204) and the following steps S205–S209 are repeatedly performed until m=M, where m=1, 2, . . . , M.

Step S205

An antenna weight $W_{null(m)}$ for a 2-element array antenna forming null in the direction θ null(m) is calculated by the following expressions (14)–(17):

$$W_{null(m)}=[w_{null_1(m)}, w_{null_2(m)}] \quad (14),$$

$$\delta w_{null(m)}=exp\{-j\cdot k\cdot d\cdot\cos(\theta\ \mathrm{null}(m))\} \quad (15)$$

$$w_{null_{131}(m)}=1 \quad (16),$$

and $$W_{\mathrm{null_2}(m)} = W_{\mathrm{null_1}(m)}'\delta W_{null(m)} \quad (17)$$

$$= \exp\{-j\cdot k\cdot d\cdot\cos(\theta null(m))\}.$$

Step S206

Using $W_{pattern}$ and $W_{null(m)}$, two antenna weight vectors $W_{beam1}$ and $W_{beam2}$ for a (N−M)-element array antenna are calculated by the following expressions (18) and (19):

$$W_{beam1}=w_{null_1(m)}\cdot W_{pattern}=l\cdot W_{pattern} \quad (18);$$

and $$W_{beam2} = W_{\mathrm{null_2}(m)}\cdot W_{pattern} \quad (19)$$

$$= \exp\{-j\cdot k\cdot d\cdot\cos(\theta null(m))\}\cdot W_{pattern}.$$

Step S207

Appending 0 to the trail end of $W_{beam1}$ to the head of $W_{beam2}$, antenna weight vectors for the (N−M+1)-element array antenna are calculated and added to produce $W_{pattern}$ using the following expression:

$$W_{pattern}=[W_{beam1}, 0]+[0, W_{beam2}] \quad (20).$$

Thereafter, m is incremented (step S208) and it is determined whether m=M (step S209). If m does not reach M (NO in step S209), control goes back to the step S205 and the steps S205–S208 are repeated until m=M.

In this manner, a final antenna weight vector $W_{pattern}=[w_{bean(1)}, \ldots, w_{beam(N)}]$ is obtained and these antenna weights are output to respective ones of the multipliers 9.1–9N. In other words, each of the beam and null directions is designated by a single complex weight and these complex weights are only multiplied and added to produce a final antenna pattern having the designated null directions θ null(1), . . . , θ null(M), resulting in decreased amount of computation.

Figure 7:
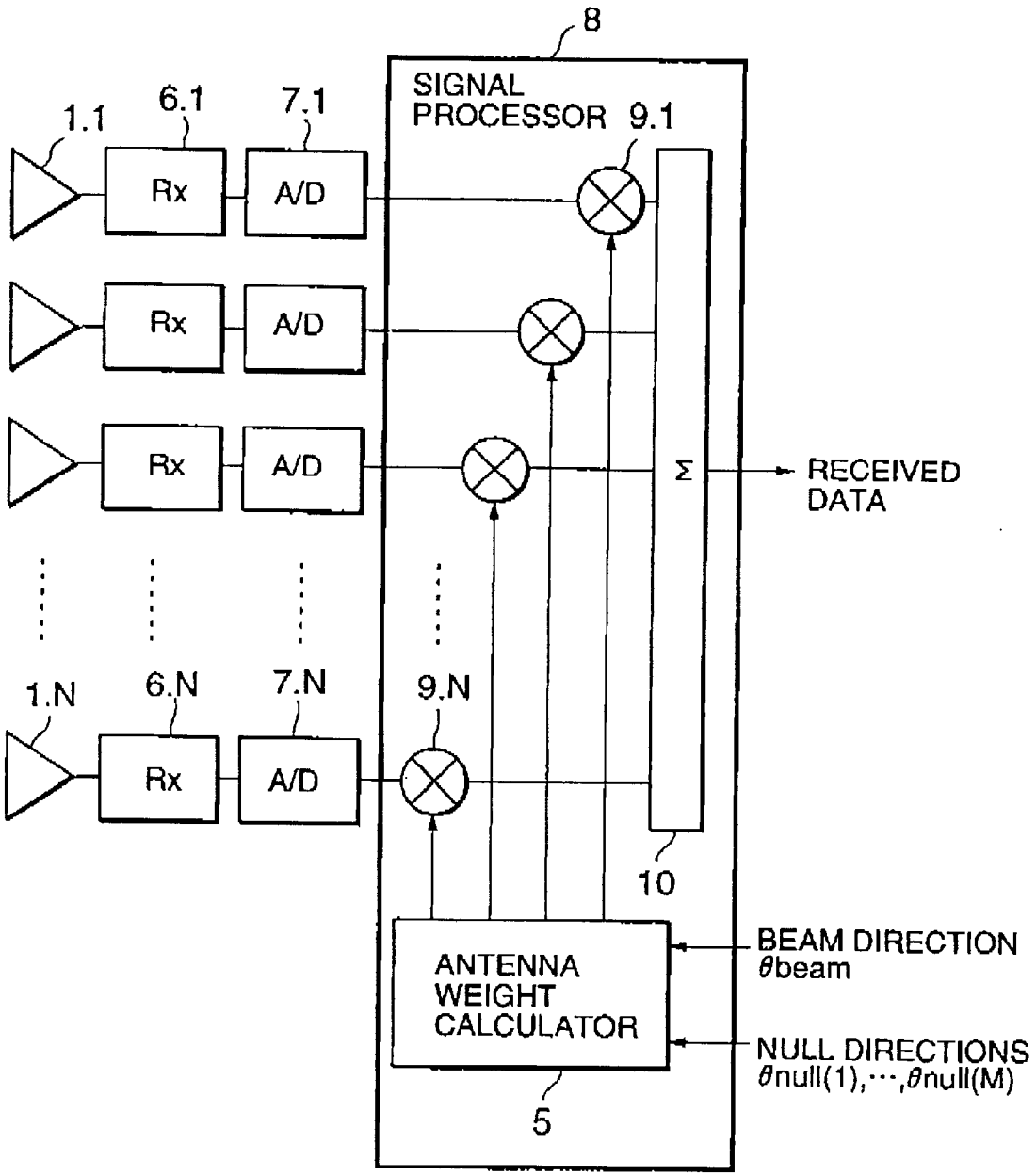
FIG. 7 is a block diagram showing a reception digital beam forming apparatus employing a null direction control method according to the present invention.

Referring to FIG. 7, an array antenna is composed of N antenna elements 1.1–1.N, which are spaced uniformly and aligned in a line. The respective antenna elements 1.1–1.N are connected to N receivers 6.1–6.N, which are in turn connected to a signal processor 8 through N analog-to-digital (A/D) converters 7.1–7.N.

The signal processor 8 includes N multipliers 9.1–9.N, an antenna weight calculator 5, and a combiner 10. The multipliers 9.1–9.N connects the A/D converters 7.1–7.N and the combiner 10 and assign antenna weights $w_{beam(1)}$–$w_{beam(N)}$ to respective ones of received data streams, respectively. The antenna weights $w_{beam(1)}$–$w_{beam(N)}$ are calculated from designated beam direction θ beam and null directions θ null(1), . . . , θ null (M) by the antenna weight calculator 5. The antenna weight calculation method is the same as that of the first embodiment and therefore the details are omitted.

The signal processor 8 including the multipliers 9.1–9.N and the antenna weight calculator 5 is implemented by a digital signal processor on which the antenna weight calculation program is running.

In the above circuit, N received signals by the N receivers 6.1–6.N through the N antenna elements 1.1–1.N are converted from analog to digital by the N A/D converters 7.1–7.N, respectively. The respective received data streams are weighed by the multipliers 9.1–9.N according to the antenna weights $w_{bean(1)}$–$w_{beam(N)}$. The weighted received data streams are combined by the combiner 10 to produce received data.

As described above, according to the present invention, antenna weights forming a designated beam null direction pattern can be obtained without the need of calculating an inverse matrix, resulting in dramatically reduced amount of computation.

What is claimed is:

1. A method for producing an antenna weight vector for an N-element array antenna to for a designated antenna pattern having a single beam direction θ beam and M null directions θ null(1)–θ null(M) (1=<M=<N−2), comprising the steps of:

a) producing a work antenna weight vector for a (N−M)-element array antenna to form a beam in the single beam direction;

b) sequentially selecting one of the M null directions;

c) producing a 2-element antenna weight vector for a 2-element array antenna to form a null in the selected null direction;

d) multiplying the work antenna weight vector by a first weight and a second weight of the 2-element antenna weight vector to produce a first work weight vector and a second work antenna weight vector;

e) appending 0 to a trail end of the first work weight vector and to a head of the second work weight vector to produce a first expanded weight vector and a second expanded weight vector, and adding the first expanded weight vector and the second expanded weight vector to produce a work antenna weight vector; and f) repeating the steps (c)–(e) until the M null directions have been selected, to produce a final work antenna weight vector as the antenna weight vector for an N-element array antenna.

2. The method according to claim 1, wherein the step (a) comprises the step of calculating the work antenna weight vector $W_{pattern}=[w_{beam(1)}, \ldots, W_{beam(N-M)}]$ using the following expressions:

$$\delta w_{beam}=exp\{-j\cdot k\cdot d\cdot\sin(\theta\ \mathrm{beam})\},$$

$$w_{beam(1)}=l,$$

and $$w_{beam(1)}=w_{beam(i-1)}\cdot\delta w_{beam}(i=2, 3, \ldots, N-M),$$

where d is a distance between antenna elements of the N-element array antenna, k is propagation constant of free space (k=2π/λ), λ is wavelength in free space.

3. The method according to claim 2, wherein the step (c) comprises the step of calculating the 2-element antenna weight vector $W_{null(m)}=[w_{null\ 1(m)}, w_{null_2(m)}]$ using the following expressions:

$$\delta w_{null(m)}=-exp\{-j\cdot k\cdot d\cdot\sin(\theta\ \mathrm{null}(m))\}\},$$

$$w_{null\ 1(m)}=1,$$

and $$w_{null_2(m)} = w_{null\ 1(m)} \cdot \delta w_{null(m)}$$

$$= -\exp\{-j \cdot k \cdot d \cdot \sin(\theta null(m))\},$$

where m=1, 2, . . . , M.

4. The method according to claim 3, wherein the step (d) comprises the step of calculating the first work weight vector $W_{beam1}$ and the second work antenna weight vector $W_{beam2}$ using the following expressions:

$$W_{beam1} = w_{null\ 1(m)} \cdot W_{pattern} = 1 \cdot W_{pattern},$$

and $$w_{beam2} = w_{null_2(m)} \cdot w_{pattern}$$

$$= \exp\{-j \cdot k \cdot d \cdot \cos(\theta null(m))\} \cdot w_{pattern}.$$

5. The method according to claim 4, wherein the step (e) comprises the steps of:

appending 0 to the trail end of the first work weight vector $W_{beam1}$ and to the head of the second work weight vector $W_{beam2}$ to produce the first expanded weight vector $[W_{beam1}, 0]$ and the second expanded weight vector $[0, W_{beam2}]$; and adding the first expanded weight vector and the second expanded weight vector to produce the work antenna weight vector $$W_{pattern} = [W_{beam1}, 0] + [0, W_{beam2}].$$

6. A method for producing an antenna weight vector for an N-element array antenna to form a designated antenna pattern having M null directions θ null(1)–θ null(M) (1=<M=<N−1), comprising the steps of:

a) arbitrarily preparing a work antenna weight vector for a (N−M)-element array antenna;

b) sequentially selecting one of the M null directions;

c) producing a 2-element antenna weight vector for a 2-element array antenna to form a null in the selected null direction;

d) multiplying the work antenna weight vector by a first weight and a second weight of the 2-element antenna weight vector to produce a first work weight vector and a second work antenna weight vector;

e) appending 0 to a trail end of the first work weight vector and to a head of the second work weight vector to produce a first expanded weight vector and a second expanded weight vector, and adding the first expanded weight vector and the second expanded weight vector to produce a work antenna weight vector; and f) repeating the stops (c)—(c) until the M null directions have been selected, to produce a final work antenna weight vector as the antenna weight vector for an N-element array antenna.

7. A program for instructing a computer to produce an antenna weight vector for an N-element array antenna to form a designated antenna pattern having a single beam direction θ beam and M null directions θ null(1)–θ null(M) (1=<M=<N−2), the program comprising the steps of;

a) producing a work antenna weight vector for a (N−M)-element array antenna to form a beam in the single beam direction;

b) sequentially selecting one of the M null directions;

c) producing a 2-element antenna weight vector for a 2-element array antenna to form a null in the selected null direction;

d) multiplying the work antenna weight vector by a first weight and a second weight of the 2-element antenna weight vector to produce a first work weight vector and a second work antenna weight vector;

e) appending 0 to a trail end of the first work weight vector and to a head of the second work weight vector to produce a first expanded weight vector and a second expanded weight vector, and adding the first expanded weight vector and the second expanded weight vector to produce a work antenna weight vector; and f) repeating the steps (c)–(e) until the M null directions have been selected, to produce a final work antenna weight vector as the antenna weight vector for an N-element array antenna.

8. A program for instructing a computer to produce an antenna weight vector for an N-element array antenna to form a designated antenna pattern having M null directions θ null(1)–θ null(M) (1=<M=<N−1), comprising the steps of:

a) arbitrarily preparing a work antenna weight vector for a (N−M)-element array antenna;

b) sequentially selecting one of the M null directions;

c) producing a 2-element antenna weight vector for a 2-element array antenna to form a null in the selected null direction;

d) multiplying the work antenna weight vector by a first weight and a second weight to the 2-element antenna weight vector to produce a first work weight vector and a second work antenna weight vector;

e) appending 0 to a trail end of the first work weight vector and to a head of the second work weight vector to produce a first expanded weight vector and a second expanded weight vector, and adding the first expanded weight vector and the second expanded weight vector to produce a work antenna weight vector; and f) repeating the steps (c)–(e) until the M null directions have been selected, to produce a final work antenna weight vector as the antenna weight vector for an N-element array antenna.

9. An apparatus for forming a designated antenna pattern, comprising;

an N-element array antenna having N antenna elements spaced uniformly and aligned in a line;

N transmitters connected to respective ones of the N antenna elements;

N digital-to-analog converters, each of which converts a corresponding stream of transmission data into an analog signal that is output to a corresponding transmitter; and a signal processor for processing the transmission data to produce N streams of transmission data which are weighted according to N antenna weights, respectively, wherein the signal processor inputs a single beam direction θ beam and M null directions θ null(1)–θ null (M) (1=<M=<N−2) and performs the steps of:

a) producing a work antenna weight vector for a (N−M)-element array antenna to form a beam in the single beam direction;

b) sequentially selecting one of the M null directions;

c) producing a 2-element antenna weight vector for a 2-element array antenna to form a null in the selected null direction;

d) multiplying the work antenna weight vector by a first weight and a second weight of the 2-element antenna weight vector to produce a first work weight vector and a second work antenna weight vector;

e) appending 0 to a trail end of the first work weight vector and to a head of the second work weight vector to produce a first expanded weight vector and a second expanded weight vector, and adding the first expanded weight vector and the second expanded weight vector to produce a work antenna weight vector; and f) repeating the steps (c)–(e) until the M null directions have been selected, to produce a final work antenna weight vector as the antenna weight vector for an N-element array antenna.

10. An apparatus for forming a designated antenna pattern, comprising:

an N-element array antenna having N antenna elements spaced uniformly and aligned in a line;

N transmitters connected to respective ones of the N antenna elements;

N digital-to-analog converters, each of which converts a corresponding stream of transmission data into an analog signal that is output to a corresponding transmitter; and a signal processor for processing the transmission data to produce N streams of transmission data which are weighted according to N antenna weights, respectively, wherein the signal processor inputs M null directions θ null(1)–θ null (M) (1=<M=<N−1), comprising the steps of:

a) arbitrarily preparing a work antenna weight vector for a (N−M)-element array antenna;

b) sequentially selecting one of the M null directions;

c) producing a 2-element antenna weight vector for a 2-element array antenna to form a null in the selected null direction;

d) multiplying the work antenna weight vector by a first weight and a second weight of the 2-element antenna weight vector to produce a first work weight vector and a second work antenna weight vector;

e) appending 0 to a trail end of the first work weight vector and to a head of the second work weight vector to produce a first expanded weight vector and a second expanded weight vector, and adding the first expanded weight vector and the second expanded weight vector to produce a work antenna weight vector; and f) repeating the steps (c)–(e) until the M null directions have been selected, to produce a final work antenna weight vector as the antenna weight vector for an N-element array antenna.

11. An apparatus for forming a designated antenna pattern, comprising:

an N-element array antenna having N antenna elements spaced uniformly and aligned in a line;

N receivers connected to respective ones of the N antenna elements, each of which produces a corresponding received signal;

N analog-to-digital converters, each of which converts a corresponding received signal to a stream of received data; and a signal processor for weighing N steams of received data according to respective ones of N antenna weights to produce received data, wherein the signal processor inputs a single beam direction θ beam and M null directions θ null(1)–θ null(M) (1=<M=<N−2) and performs the steps of;

a) producing a work antenna weight vector for a (N−M)-element array antenna to form a beam in the single beam direction;

b) sequentially selecting one of the M null directions;

c) producing a 2-element antenna weight vector for a 2-element array antenna to form a null in the selected null direction;

d) multiplying the work antenna weight vector by a first weight and a second weight of the 2-element antenna weight vector to produce a first work weight vector and a second work antenna weight vector;

e) appending 0 to a trail end of the first work weight vector and to a head of the second work weight vector to produce a first expanded weight vector and a second expanded weight vector, and adding the first expanded weight vector and the second expanded weight vector to produce a work antenna weight vector; and f) repeating the steps (c)–(e) until the M null directions have been selected, to produce a final work antenna weight vector as the antenna weight vector for an N-element array antenna.

12. An apparatus for forming a designated antenna pattern, comprising:

an N-element array antenna having N antenna elements spaced uniformly and aligned in a line;

N receivers connected to respective ones of the N antenna elements, each of which produces a corresponding received signal;

N analog-to-digital converters, each of which converts a corresponding received signal to a stream of received data, and a signal processor for weighing N steams of received data according to respective ones of N antenna weights to produce received data, wherein the signal processor inputs M null directions θ null(1)–θ null(M) (1=<M=<N<1), comprising the steps of:

a) arbitrarily preparing a work antenna weight vector for a (N−M)-element array antenna;

b) sequentially selecting one of the M null directions;

c) producing a 2-element antenna weight vector for a 2-element array antenna to form a null in the selected null direction;

d) multiplying the work antenna weight vector by a first weight and a second weight of the 2-element antenna weight vector to produce a first work weight vector and a second work antenna weight vector;

e) appending 0 to a trail end of the first work weight vector and to a head of the second work weight vector to produce a first expanded weight vector and a second expanded weight vector, and adding the first expanded weight vector and the second expanded weight vector to produce a work antenna weight vector; and f) repeating the steps (c)–(e) until the M null directions have been selected, to produce a final work antenna weight vector as the antenna weight vector for an N-element array antenna.

* * * * *

UNITED STATES PATENT AND TRADEMARK OFFICE

CERTIFICATE OF CORRECTION

PATENT NO. : 6,633,265 B2
DATED : October 14, 2003
INVENTOR(S) : Masashi Hirabe

It is certified that error appears in the above-identified patent and that said Letters Patent is hereby corrected as shown below:

Column 5,
Line 45, delete "direction$\theta$" insert -- direction $\theta$ --

Column 7,
Line 5, delete "$^{w}null_{13}$" insert -- $^{w}null_$ --

Column 8,
Line 63, delete "}}" insert -- } --

Signed and Sealed this

Sixth Day of April, 2004

JON W. DUDAS
*Acting Director of the United States Patent and Trademark Office*